US008590538B2

(12) United States Patent
Croll

(10) Patent No.: US 8,590,538 B2
(45) Date of Patent: Nov. 26, 2013

(54) STABILIZER MOUTHGUARD

(76) Inventor: Theodore P. Croll, Doylestown, PA (US)

( * ) Notice: Subject to any disclaimer, the term of this patent is extended or adjusted under 35 U.S.C. 154(b) by 90 days.

(21) Appl. No.: 13/313,495

(22) Filed: Dec. 7, 2011

(65) Prior Publication Data

US 2013/0146066 A1 Jun. 13, 2013

(51) Int. Cl.
*A61C 5/14* (2006.01)

(52) U.S. Cl.
USPC ..... 128/861; 128/859

(58) Field of Classification Search
USPC ..... 128/861–863, 848; 602/902; 433/6, 19, 433/7, 24, 140; 601/38
See application file for complete search history.

(56) References Cited

U.S. PATENT DOCUMENTS 4,773,853 A 9/1988 Kussick
5,692,523 A * 12/1997 Croll et al. ..... 128/859
5,727,564 A * 3/1998 Yannalfo ..... 128/846
5,855,535 A * 1/1999 Shafer ..... 482/11
6,510,853 B1 1/2003 Kittelsen et al.
8,151,799 B1 * 4/2012 Hazard et al. ..... 128/859
8,505,541 B2 * 8/2013 Bardach et al. ..... 128/861
2007/0131232 A1 6/2007 Bancroft
2009/0165805 A1 * 7/2009 Syrop et al. ..... 128/861
2010/0108078 A1 * 5/2010 Morgan et al. ..... 128/861
2012/0090625 A1 * 4/2012 Evans et al. ..... 128/861

* cited by examiner

*Primary Examiner* — Patricia Bianco
*Assistant Examiner* — Kari Petrik
(74) *Attorney, Agent, or Firm* — Gregory J. Gore

(57) ABSTRACT

A mouthguard includes lateral cheek compaction domes which compressibly fill the space between the inside of the cheek and the rear teeth when worn. The domes are ellipsoid in shape and provide elasticity which allows the muscles of the cheek to comfortably grip the mouthguard. The internal aspects of the cheek compress the domes against the outer tooth and gum surfaces to hold the mouthguard in place even when the teeth are not biting on the bite plate section. This holds the mouthguard in place as the jaws move when speaking or during deep breathing.

4 Claims, 2 Drawing Sheets

STABILIZER MOUTHGUARD

FIELD OF THE INVENTION

This invention relates to mouthguards worn to protect human teeth from injury. More particularly, it relates to a mouthguard of such a construction to stabilize its position in the mouth to compensate for differences in the facial anatomy among users.

BACKGROUND OF THE INVENTION

Mouthguards of the type worn by athletes to protect their teeth during sports activity have been produced in many different configurations and materials. In all cases, these mouthguards are basically U-shaped with a vertically upstanding side surface and an adjoining horizontal plate that is gripped between the teeth of the upper and lower jaw. There are mouthguards which are personally custom-fit and others which are one-size fits all mouthguards of a standard size. The one-size mouthguards can be much less expensively produced.

There is a problem however with standard size mouthguards in that the mouthguards often move around in the wearer's mouth unless the upper and lower teeth squeeze the bite plate. This floppiness can interfere with speaking and requires a purposeful effort on the part of the user to remember to bite down. Furthermore, in the event of lateral facial blows, greater protection of the back teeth is required than is provided by present mouthguards.

SUMMARY OF THE INVENTION

In order to supply the need in the art for an improved mouthguard, the present device has been devised. While similar in construction to most mouthguards in some ways, the present mouthguard includes novel lateral cheek compaction domes which compressibly fill the space between the inside of the cheek and the rear teeth. The domes are ellipsoid in shape and provide elasticity which allows the muscles of the cheek to comfortably grip the mouthguard. The internal aspects of the cheek compress the domes against the outer tooth and gum surfaces to hold the mouthguard in place even when the teeth are not biting on the bite plate section. Thus, the mouthguard is held in place as the jaws move when speaking or during deep breathing. Also, the padding of the mouthguard in the area of the compaction domes provides a thicker and broader compression area which covers much more of the posterior anatomical area than other designs. This is particularly important with orthodontic patients because the interior aspect that lips and cheeks can suffer lacerations and puncture wounds with impact forces of facial blows during sports activities or other traumatic episodes.

More specifically, the Applicant has devised a protective mouthguard comprising a U-shaped bite plate adapted for positioning between the teeth of the upper and lower jaws of the user and having two rearward extremities. The mouthguard has a substantially vertical U-shaped sidewall extending upward and downward from an outside edge of the bite plate and rear portions adjacent the two extremities. Two ellipsoid compaction domes located on an outer surface of the sidewall rear portions each have a compressible arcuate surface extending outwardly from the sidewall. The domes are located centered on the lateral plane of the bite plate and have a diameter equal to the vertical dimension of rear portions of the sidewall at its greatest vertical dimension. The mouthguard is a unitary apparatus molded from an elastomeric material and the sidewall includes a plurality of frontal breathing holes with at least one above and one below the bite plate.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

DESCRIPTION OF THE PREFERRED EMBODIMENT

Figure 1:
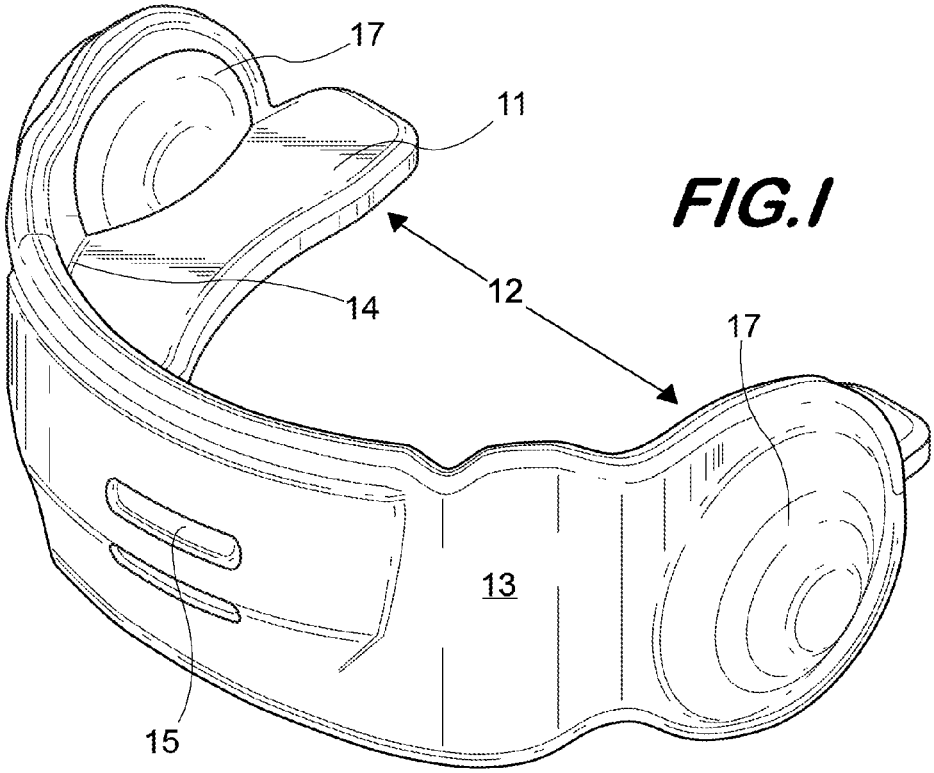
FIG. 1 is a top right front isometric view.

Referring now to FIG. 1, the mouthguard of the present invention is depicted. The mouthguard is generally U-shaped having a horizontal bite plate 11 and a substantially vertical U-shaped sidewall 13 extending upward and downward from an outside edge 14 of the bite plate. The bite plate has two rearward extremities 12 where two ellipsoid compaction domes are located on the outer surface of rear portions of the sidewall. The diameter of the domes 17 represent the greatest vertical dimension of the sidewall and project outwardly and inwardly from sidewall 13. Two frontal breathing holes 15 pass through the sidewall, one above and one below the bite plate 11.

Figure 2:
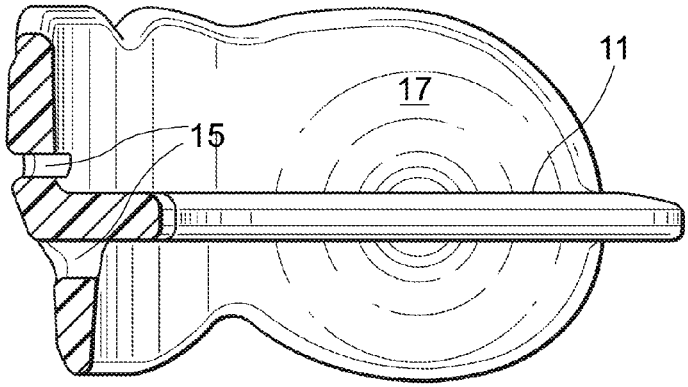
FIG. 2 is a rear elevation cross-section view.
Figure 3:
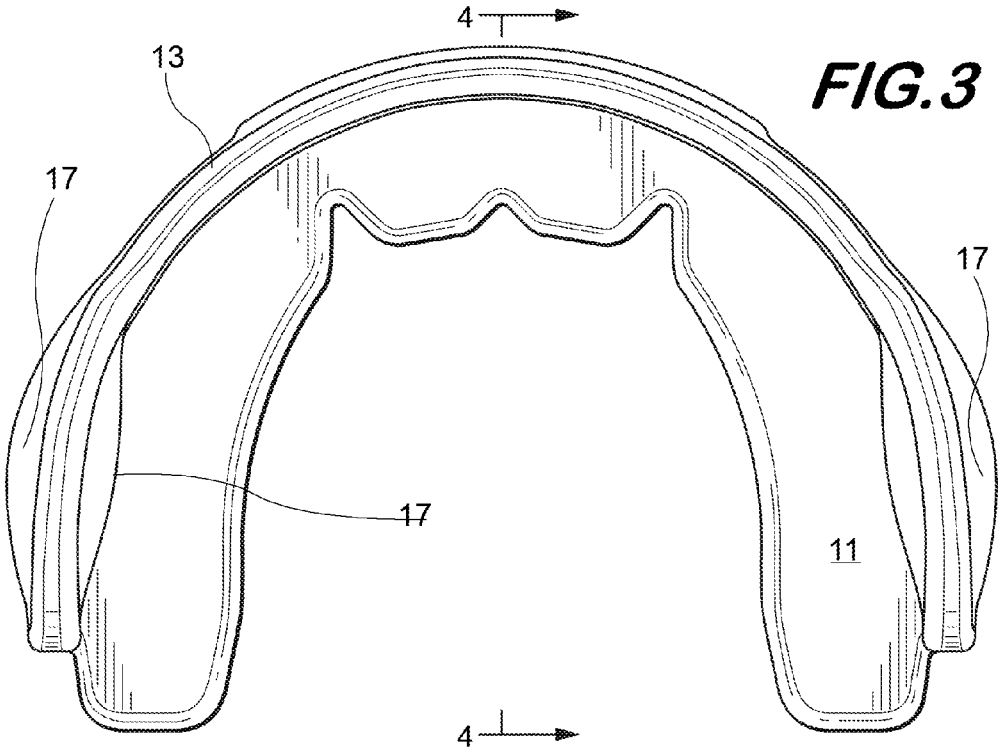
FIG. 3 is a top plan view.

Referring now to FIG. 2, the compaction domes 17 are generally disposed centered on the lateral plane of the bite plate 11. The diameter of the domes is substantially equal to the vertical dimension of the sidewall rear portions. The breathing holes 15 are positioned for the greatest efficiency being staggered vertically. As seen from this Figure, the lower portion of the sidewall 13 is offset rearwardly at the front to conform to the most common anatomical disposition of the teeth. With regard to FIG. 3, the location and bulbous shape of the compaction domes 17 are further shown.

Figure 4:
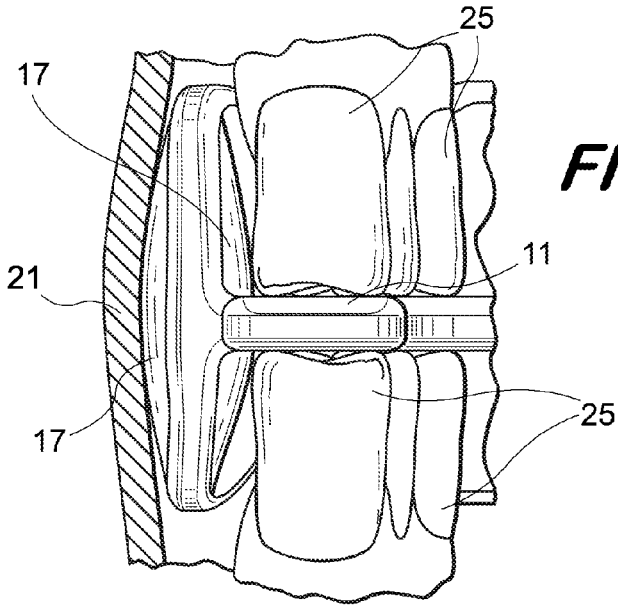
FIG. 4 is a right side elevation partial cross-section view.

Referring now to FIG. 4, the compaction domes 17 extend outwardly from the outer surface of the sidewall forming bulbous arcuate cushions which are wedged between the user's cheeks 21 and rear teeth 25. This provides added protection for the rear teeth 25 and stabilizes the mouthguard against unwanted movement whenever the bite plate 11 is not gripped between the teeth 25. The present mouthguard is preferably a unitary apparatus molded from a suitable elastomeric material which provides effective cushioning. Suitable materials include ethylene vinyl acetate (EVA), a low density polyethylene polymer and polyolefin foam, however, the present invention is not limited to these materials.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A protective mouthguard, comprising:

a U-shaped bite plate adapted for positioning between teeth of upper and lower jaws of a user, said bite plate having two rearward extremities;

a substantially vertical U-shaped sidewall extending upward and downward from an outside edge of said bite plate and having rear portions adjacent the two extremities; and two ellipsoid compaction domes located on the sidewall rear portions, each of said domes having a compressible arcuate surfaces extending outwardly and inwardly from said sidewall said domes being forcibly captured between the user's rear teeth and cheeks when worn to hold the mouthguard in place wherein said domes are located centered on a lateral plane of said bite plate and have a diameter substantially equal to a vertical dimension of said sidewall rear portions.

2. The mouthguard of claim 1 being a unitary apparatus molded from an elastomeric material.

3. The mouthguard of claim 2 wherein said sidewall further includes a plurality of frontal breathing holes with at least one above and one below said bite plate.

4. The mouthguard of claim 2 wherein the elastomeric material is selected from the group consisting of ethylene vinyl acetate, low-density polyethylene and polyolefin foam.

* * * * *